US009735493B2

(12) United States Patent
Lin

(10) Patent No.: US 9,735,493 B2
(45) Date of Patent: Aug. 15, 2017

(54) POWER OUTLET HAVING SAFETY COVER

(71) Applicant: CYBER POWER SYSTEMS, INC., Taipei (TW)

(72) Inventor: Chih-Heng Lin, Taipei (TW)

(73) Assignee: CYBER POWER SYSTEMS, INC., Taipei (TW)

( * ) Notice: Subject to any disclaimer, the term of this patent is extended or adjusted under 35 U.S.C. 154(b) by 0 days.

(21) Appl. No.: 15/378,719

(22) Filed: Dec. 14, 2016

(65) Prior Publication Data

US 2017/0187138 A1 Jun. 29, 2017

(30) Foreign Application Priority Data

Dec. 28, 2015 (TW) ..... 104144102 A

(51) Int. Cl.

| | |
|---|---|
| ***H01R 13/44*** | (2006.01) |
| ***H01R 13/453*** | (2006.01) |
| ***H01R 25/00*** | (2006.01) |
| ***H01R 24/78*** | (2011.01) |
| *H01R 103/00* | (2006.01) |

(52) U.S. Cl.

CPC ..... *H01R 13/4534* (2013.01); *H01R 24/78* (2013.01); *H01R 25/006* (2013.01); *H01R 2103/00* (2013.01)

(58) Field of Classification Search

CPC .. H01R 13/4534; H01R 24/78; H01R 25/006; H01R 2103/00

USPC ..... 439/145, 135, 137

See application file for complete search history.

(56) References Cited

U.S. PATENT DOCUMENTS 4,722,693 A * 2/1988 Rose ..... H01R 13/4534 439/137

8,550,829 B2 * 10/2013 Huang ..... H01R 13/4534 439/127

FOREIGN PATENT DOCUMENTS

| | | | | |
|---|---|---|---|---|
| CN | 102044786 | * | 2/2013 | ..... H01R 13/453 |
| CN | 102044786 B | | 2/2013 | |
| TW | 321370 U | | 11/1997 | |
| TW | M240693 U | | 8/2004 | |

OTHER PUBLICATIONS

Official Action in Corresponding Taiwan Application No. 104144102, Dated May 12, 2017.

* cited by examiner

*Primary Examiner* — Javaid Nasri

(74) *Attorney, Agent, or Firm* — Bacon & Thomas, PLLC

(57) ABSTRACT

A power outlet having safety cover, the power outlet comprises a shell body, a base fixed in the shell body, a sliding element disposed between the shell body and the base; the shell body has at least one first outlet hole and at least one second outlet hole; the base has a first post, a third outlet hole and a fourth outlet hole; one side of the sliding element has a first inclined block, the middle of the sliding element has a through hole, another side of the sliding element has a second inclined block and a second post; an elastic element is disposed between the first post and the second post; wherein the through hole can contain the first post, the second post and the elastic element; a distance between the first inclined block and an inner wall of the base is smaller than the length of the elastic element.

16 Claims, 13 Drawing Sheets

POWER OUTLET HAVING SAFETY COVER

BACKGROUND OF THE INVENTION

1. Field of the Invention

The invention relates to a power outlet, and more particularly to a power outlet having safety cover, the power outlet has a base and a sliding element inside, the base has a first post, the sliding element has a through hole and a second post, an elastic element is disposed between the first post and the second post; the through hole can contain the first post, the second post and the elastic element.

2. Description of Related Art

A first prior-art is disclosed in U.S. Pat. No. 4,722,693, the first prior-art disclosed a safety shutter can be swayed to an angled portion or another angled portion when an object (e.g., nail) is inserted into a single slot or another slot, therefore the safety shutter can stop the object. But a spring is disposed on one side of the safety shutter, the first prior-art needs extra space to dispose the spring, so that total volume of receptacle safety device can not further be reduced; and the two slots is biased on front surface of receptacle safety device, that will affect the symmetry of appearance of the front surface. Thus, there is a requirement of improvement for the first prior-art.

A second prior-art is disclosed in U.S. Pat. No. 8,550,829 (its patent family has China patent CN102044786B), the second prior-art disclosed the hollow frame of left shield has a left lock-up step at the inner edge for sliding under the right shield stop block, the hollow frame of right shield has a left lock-up step at the inner edge for sliding under the left shield stop block. A plug is not allowed to be connected until the stop blocks of both shields move simultaneously and remove respective lock-up steps from the plug pin entry path. But the second prior-art needs the two shields and a middle-layer support, the middle-layer support needs to form a sliding platform, the structure of the two shields and a middle-layer support are more complex, manufacturing costs and product defect rate are relatively high. Moreover, the two shields are two-way sliding; when the plug is inserted, the second prior-art needs an insertion force which is great than the first prior-art, so as to push the two shields. Thus, there is a requirement of improvement for the second prior-art.

SUMMARY OF THE INVENTION

It is therefore a first object of the invention to provide a power outlet having safety cover, the power outlet comprises a shell body, a base fixed in the shell body, a sliding element disposed between the shell body and the base; the shell body has at least one first outlet hole and at least one second outlet hole; the base has a first post, a third outlet hole and a fourth outlet hole; one side of the sliding element has a first inclined block, the middle of the sliding element has a through hole, another side of the sliding element has a second inclined block and a second post; an elastic element is disposed between the first post and the second post; wherein the through hole can contain the first post, the second post and the elastic element.

It is therefore a first object of the invention to provide a power outlet having safety cover, the power outlet comprises a shell body, a base fixed in the shell body, a sliding element disposed between the shell body and the base; the shell body has at least one first outlet hole and at least one second outlet hole; the base has a first post, a third outlet hole and a fourth outlet hole; one side of the sliding element has a first inclined block, the middle of the sliding element has a through hole, another side of the sliding element has a second inclined block and a second post; an elastic element is disposed between the first post and the second post; wherein a distance between the first inclined block and an inner wall of the base is smaller than the length of the elastic element.

First advantages of the invention is, the sliding element of the power outlet has a through hole, the through hole can contain an elastic element, therefore a distance between a first inclined block of the sliding element and an inner wall of the base is smaller than the length of the elastic element, that will reduce the disposing space of the elastic element. Thus, the total volume of power outlet can further be reduced.

Second advantages of the invention is, the base of the power outlet has a first location portion, the sliding element has a first location block; when an object is inserted into a first outlet hole of the shell body, the first location portion can stop the first location block to locate the sliding element. Moreover, the base has a second location portion, the sliding element has a second location block; when an object is inserted into a second outlet hole of the shell body, the second location portion can stop the second location block to locate the sliding element.

Third advantages of the invention is, the base of the power outlet has a hook, the sliding element has a recess portion; when an object is inserted into a second outlet hole of the shell body, the hook can locate the position of recess portion, thereby preventing a first inclined block of the sliding element to insert into a first outlet hole of the shell body. Furthermore, the hook can limit the position of the sliding element.

The above and other objects, features and advantages of the invention will become apparent from the following detailed description taken with the accompanying drawings.

DETAILED DESCRIPTION OF THE INVENTION

Figure 1:
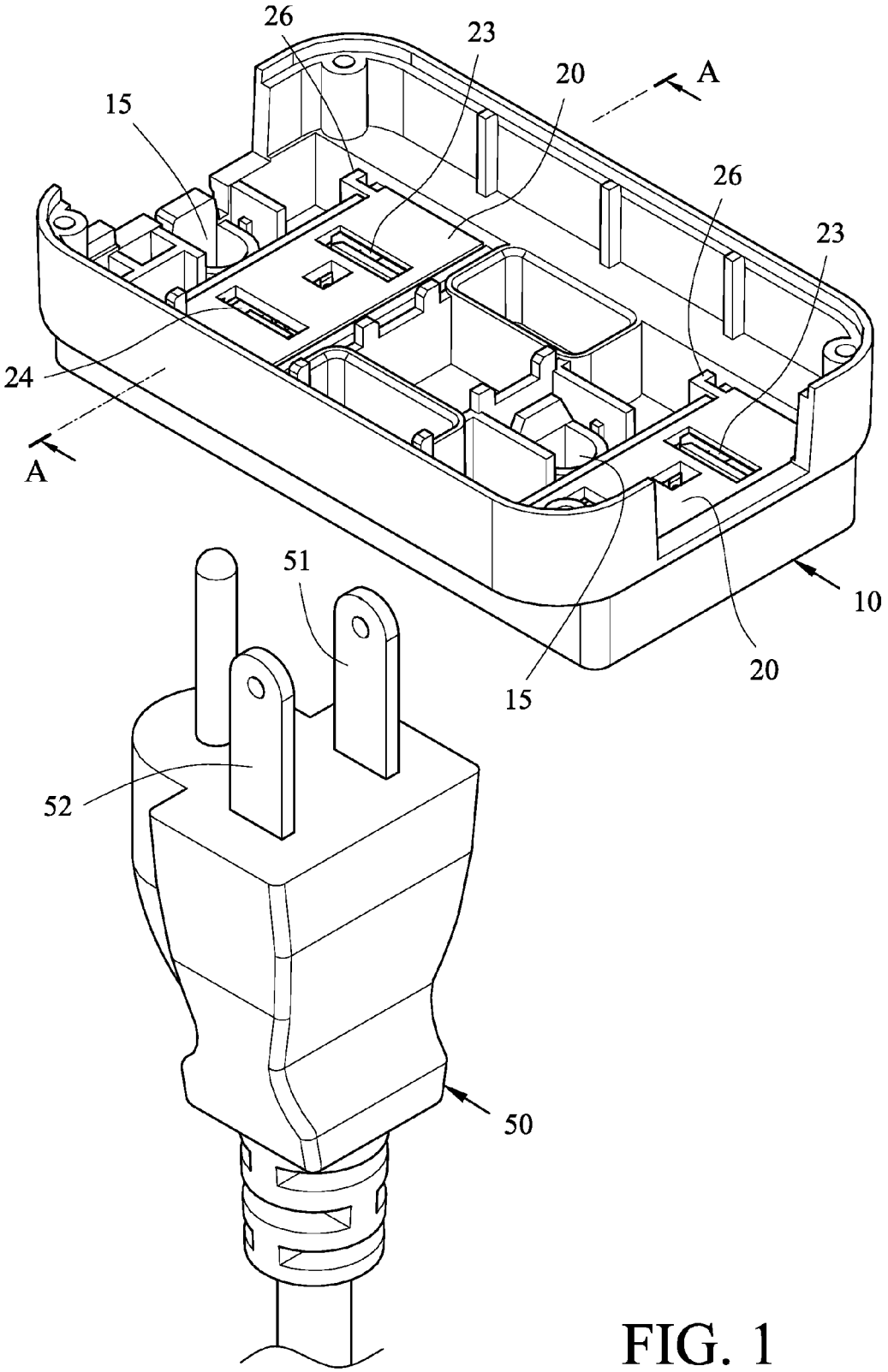
FIG. 1 is a perspective view showing a first preferred embodiment of the invention.
Figure 2:
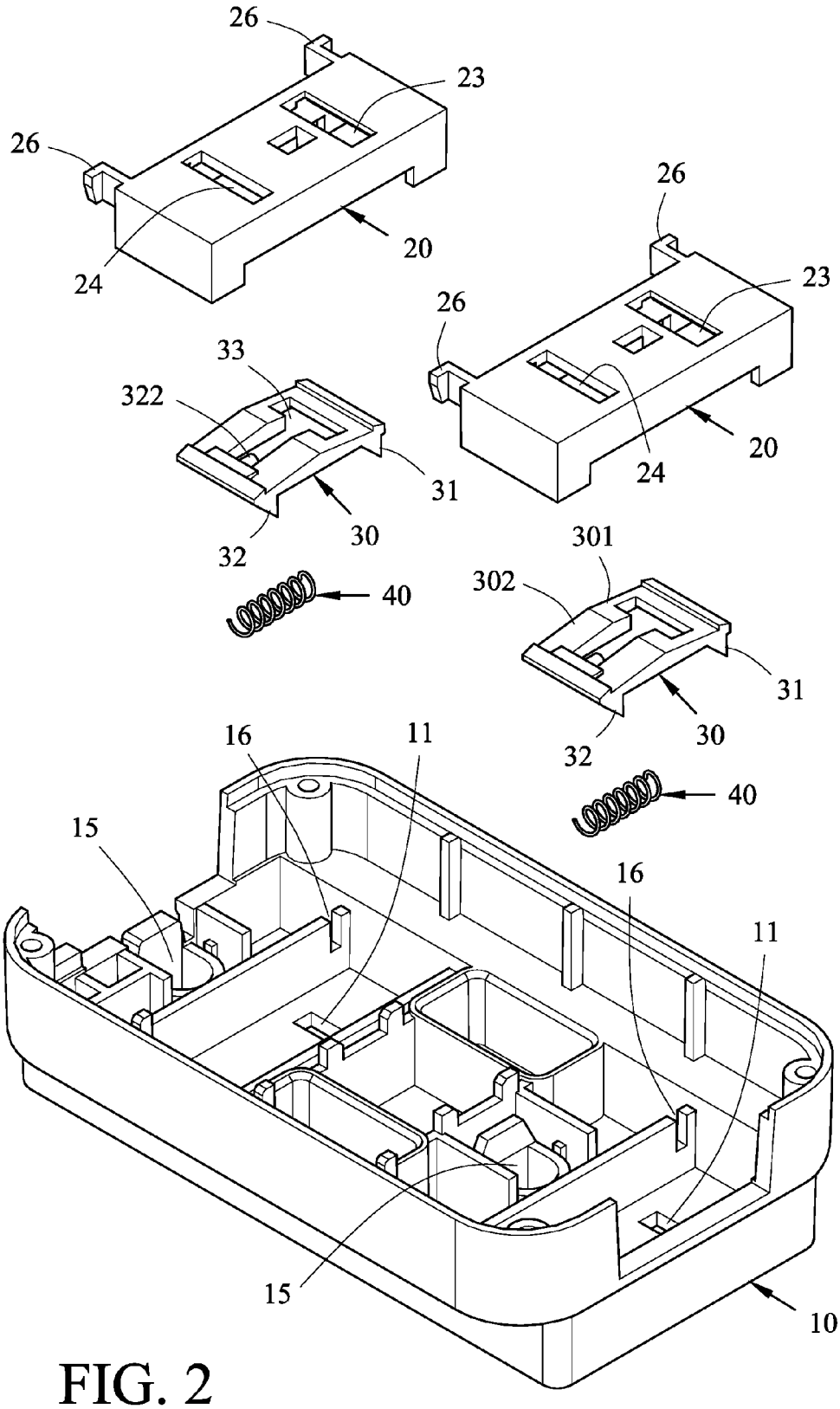
FIG. 2 is a first partially exploded view showing the first preferred embodiment of the invention.
Figure 3:
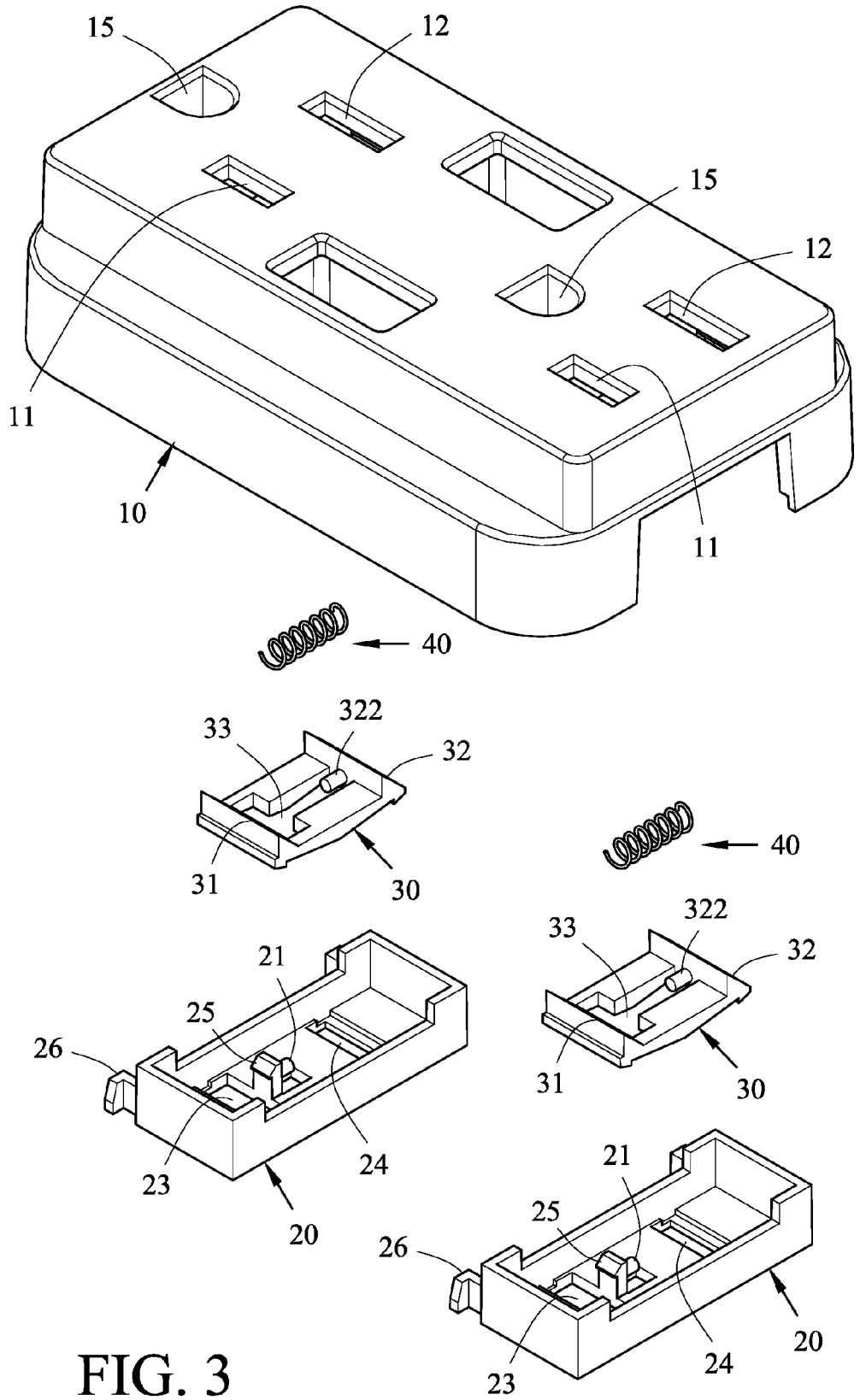
FIG. 3 is a second partially exploded view showing the first preferred embodiment of the invention.

Referring to FIGS. 1 to 5, a power outlet having safety cover in accordance with a first embodiment of the invention comprises a shell body 10, at least one base 20, at least one sliding element 30 and at least one elastic element (e.g., a spring 40); the shell body 10 has at least one first outlet hole 11 and at least one second outlet hole 12; the base 20 is fixed in the shell body 10, the base 20 has a first post 21, a third outlet hole 23 and a fourth outlet hole 24; the sliding element 30 is disposed between the shell body 10 and the base 20; one side of the sliding element 30 has a first inclined block 31, the middle of the sliding element 30 has a through hole 33, another side of the sliding element 30 has a second inclined block 32 and a second post 322; the elastic element (e.g., a spring 40) is disposed between the first post 21 and the second post 322; wherein the through hole 33 can contain the first post 21, the second post 322 and the elastic element (e.g., a spring 40). Thus, a distance X between the first inclined block 31 and an inner wall 201 of the base 20 is smaller than the length L of the elastic element (e.g., a spring 40), that will reduce the disposing space of the elastic element (e.g., a spring 40), therefore, the total volume of power outlet can further be reduced.

Figure 6:
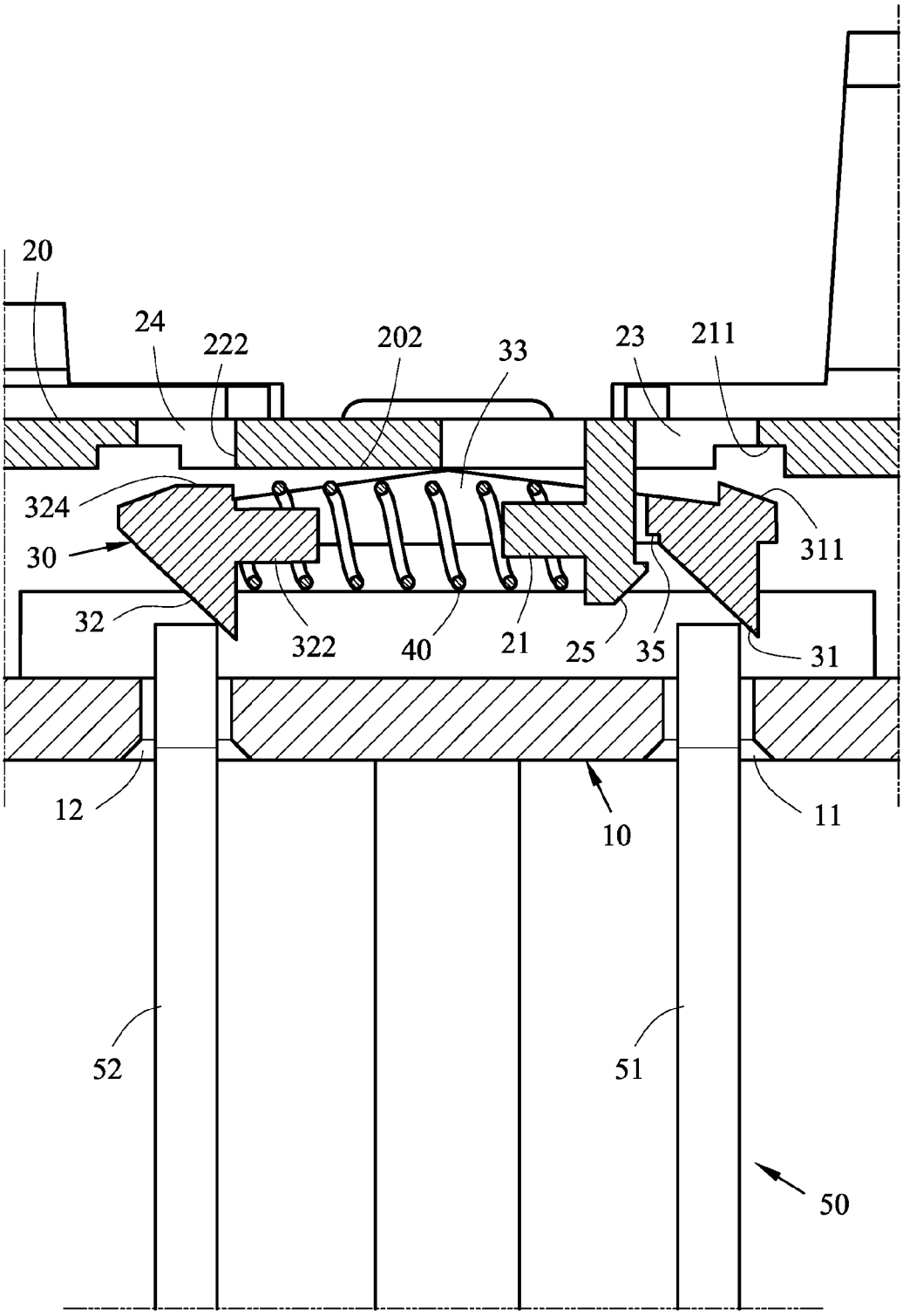
FIG. 6 is a first operation diagram illustrating the first operation of the first preferred embodiment of the invention.
Figure 7:
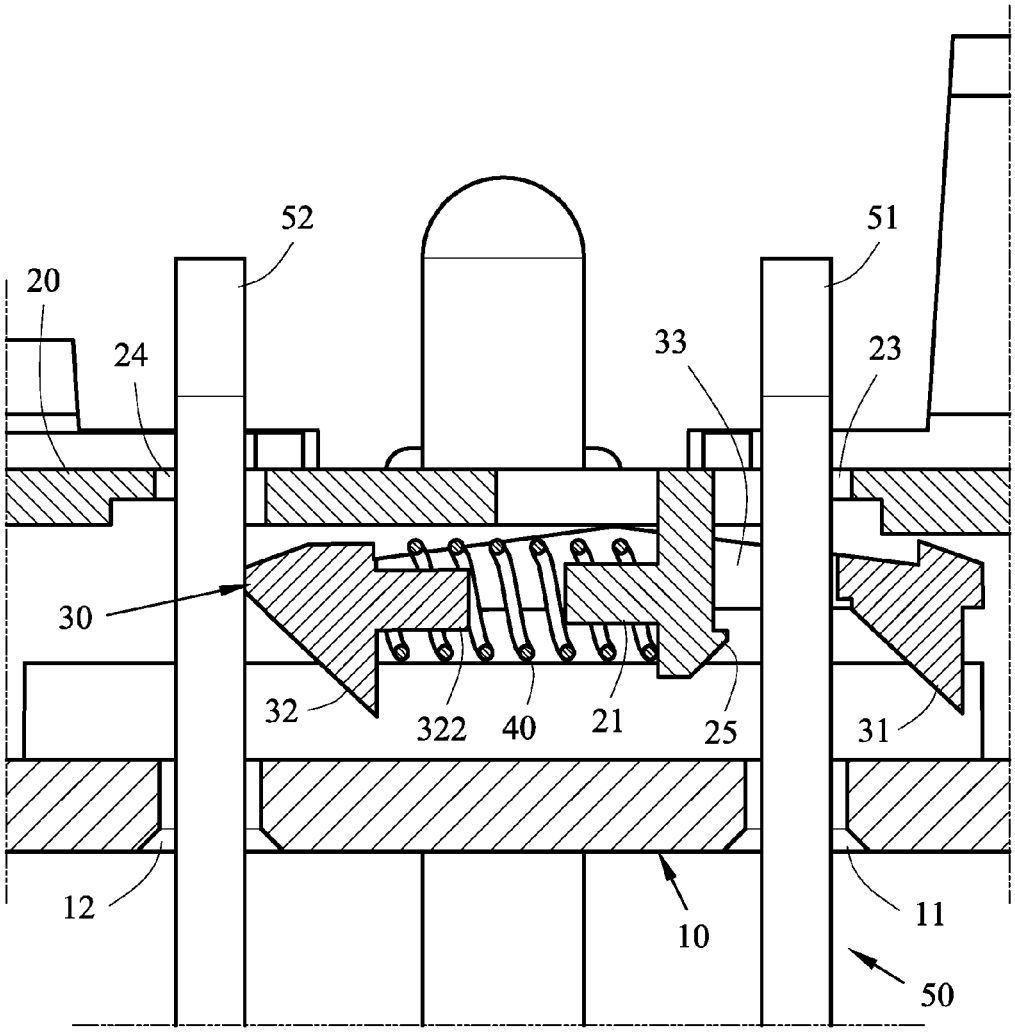
FIG. 7 is a second operation diagram illustrating the second operation of the first preferred embodiment of the invention.

Referring to FIGS. 6 to 7, examples of operation of the sliding element 30; when a first terminal 51 and a second terminal 52 of a plug 50 respectively insert into the first outlet hole 11 and the second outlet hole 12, the first terminal 51 and the second terminal 52 will respectively push the first inclined block 31 and the second inclined block 32, therefore the sliding element 30 can slide to compress the elastic element (e.g., a spring 40), the first terminal 51 can pass through the through hole 33 and the third outlet hole 23, the second terminal 52 can pass through the fourth outlet hole 24.

Figure 8:
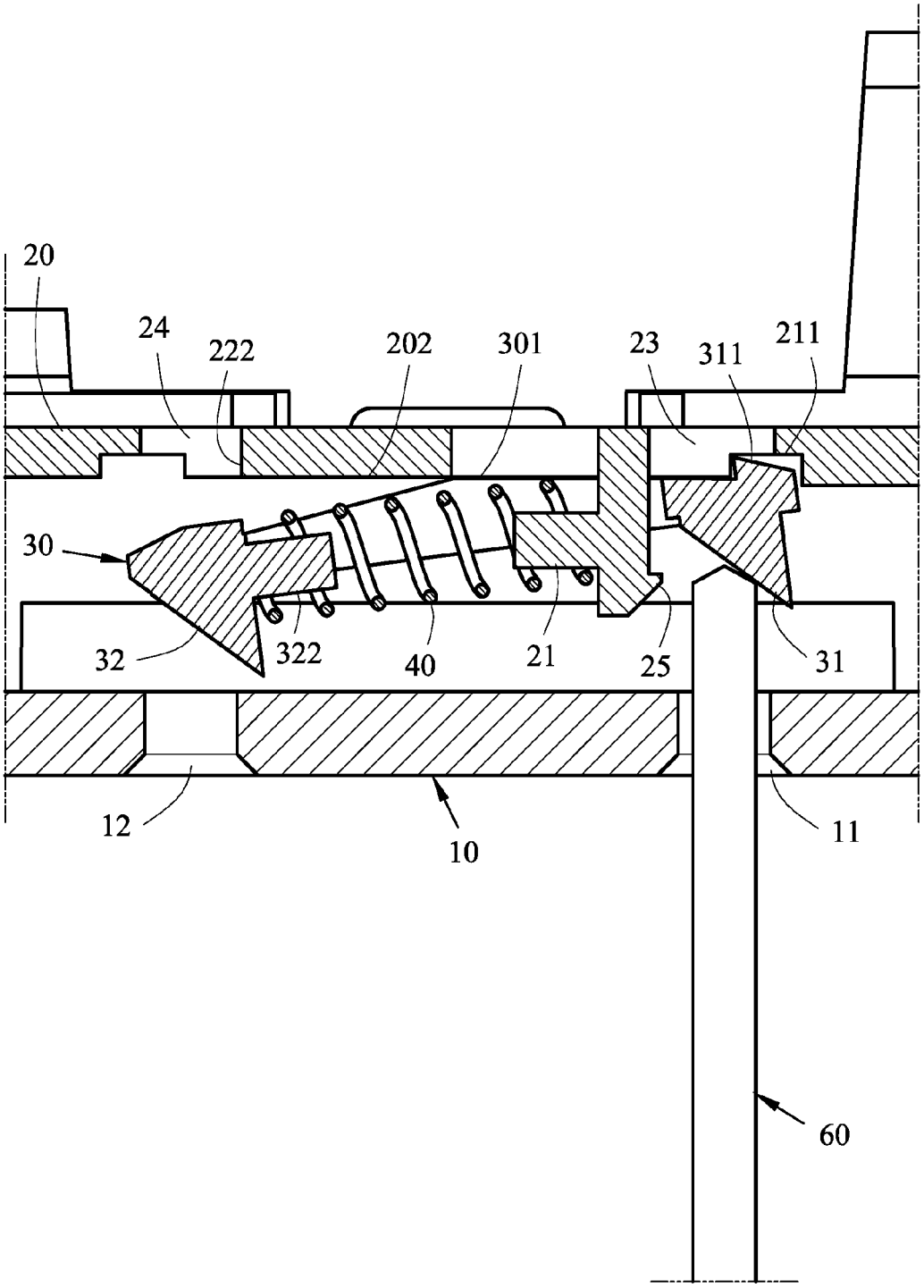
FIG. 8 is a third operation diagram illustrating the third operation of the first preferred embodiment of the invention.

Referring to FIG. 8, examples of a first variation of the base 20 and the sliding element 30; the base 20 has a first location portion 211, the sliding element 30 has a first location block 311; when a single object 60 is inserted into the first outlet hole 11, the object 60 will push the first inclined block 31, the first location portion 211 can stop the first location block 311 to locate the position of the sliding element 30, the first inclined block 31 can block the object 60 to pass through the third outlet hole 23.

Figure 9:
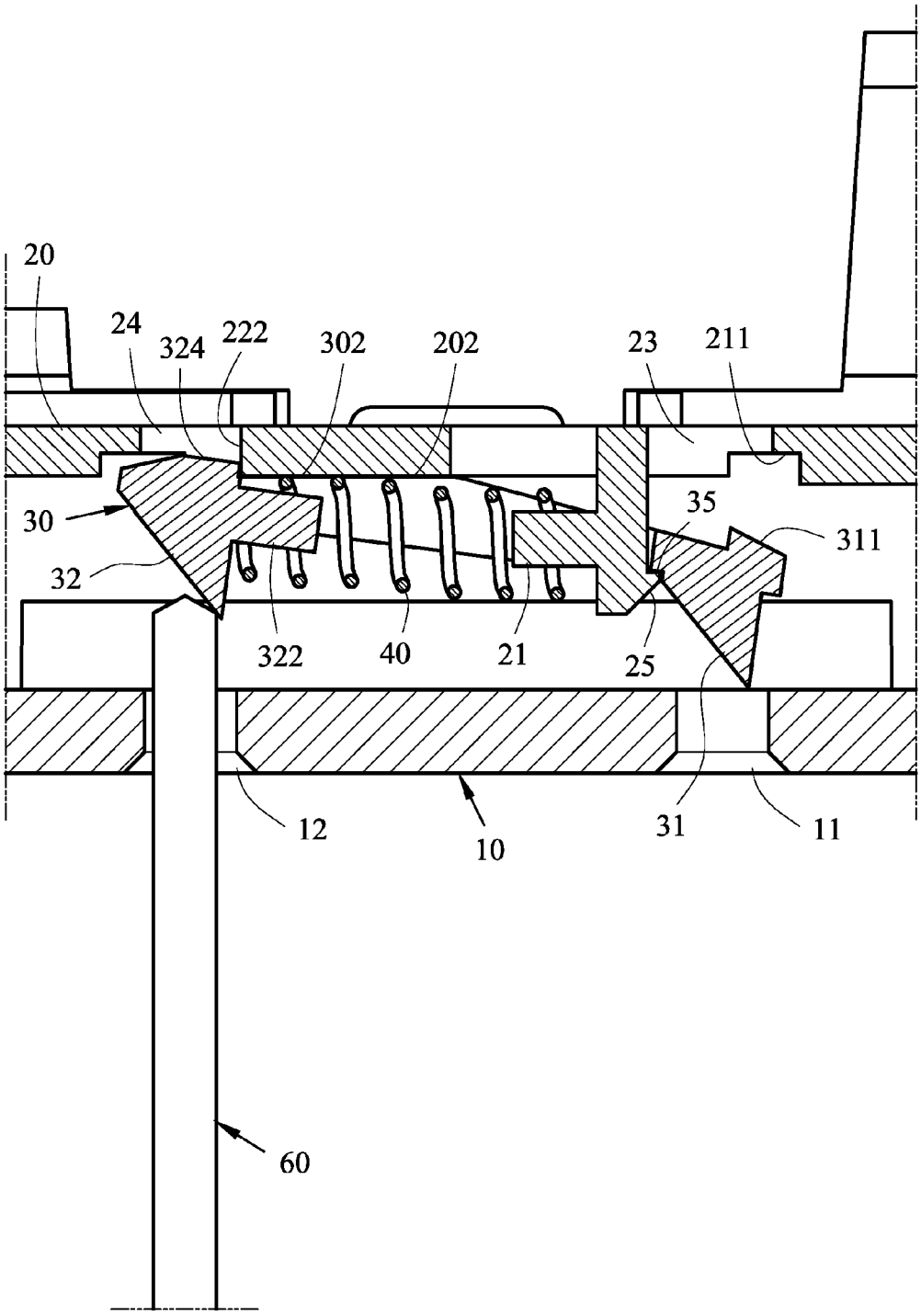
FIG. 9 is a fourth operation diagram illustrating the fourth operation of the first preferred embodiment of the invention.

Referring to FIG. 9, examples of a second variation of the base 20 and the sliding element 30; the base 20 has a second location portion 222, the sliding element 30 has a second location block 324; when a single object 60 is inserted into the second outlet hole 12, the object 60 will push the second inclined block 32, the second location portion 222 can stop the second location block 324 to locate the position of the sliding element 30, the second inclined block 32 can block the object 60 to pass through the fourth outlet hole 24.

Figure 4:
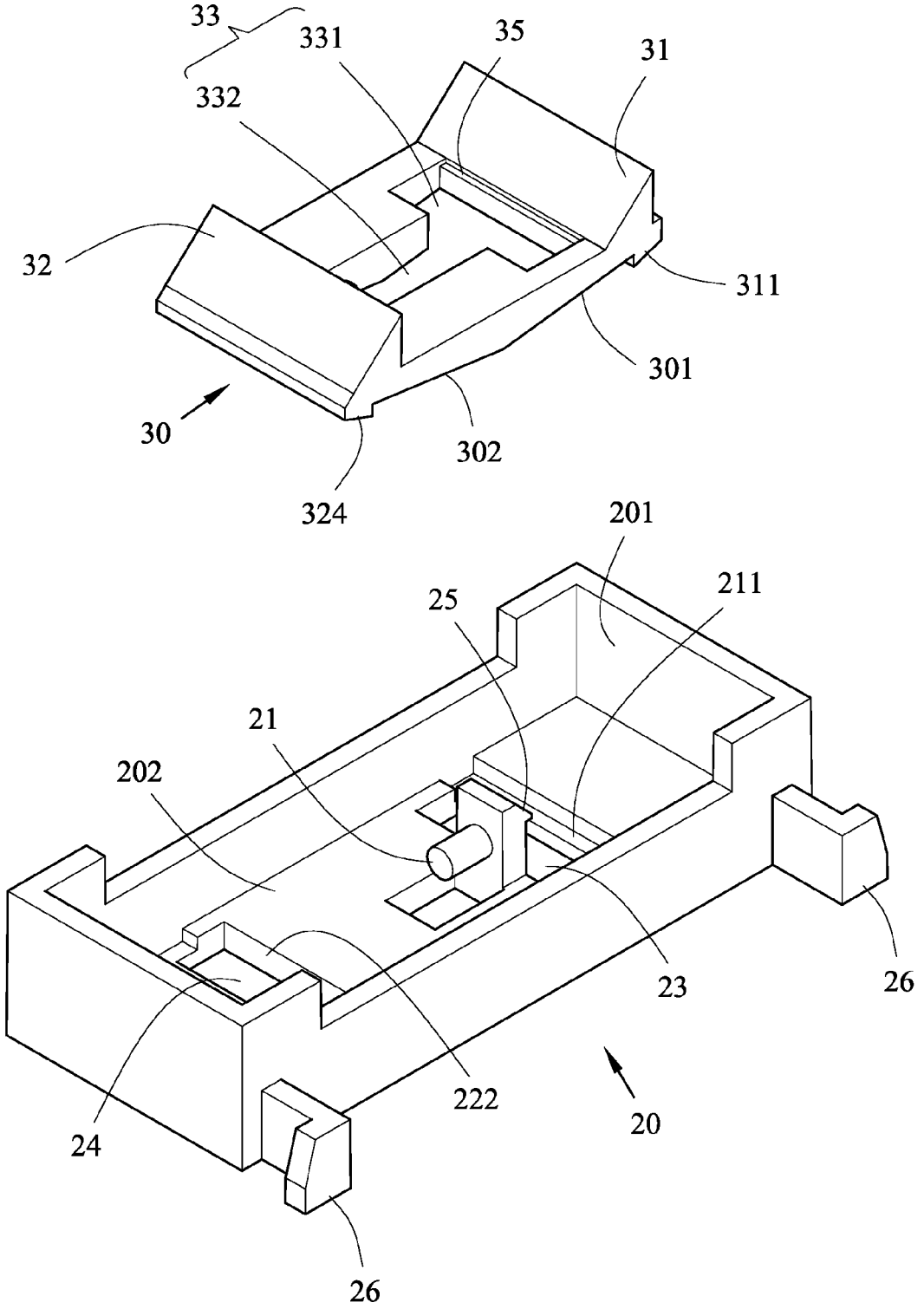
FIG. 4 is a perspective view showing a base and a sliding element of the first preferred embodiment of the invention.
Figure 5:
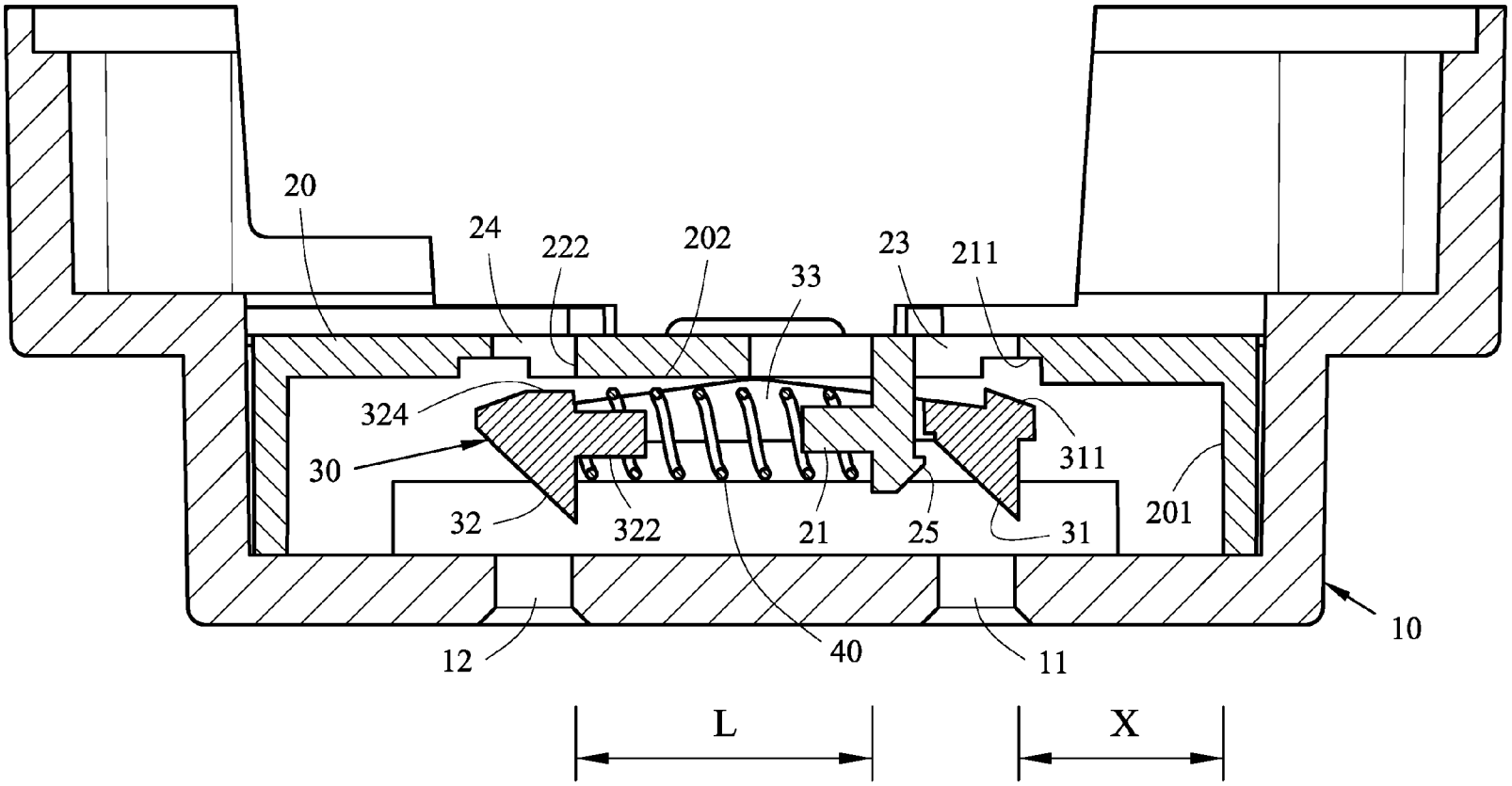
FIG. 5 is a cross-sectional view along a line A-A of FIG. 1 showing the first preferred embodiment of the invention.

Examples of a third variation of the base 20 and the sliding element 30; the base 20 has a hook 25, the sliding element 30 has a recess portion 35; when a single object 60 is inserted into the second outlet hole 12, the object 60 will push the second inclined block 32, the hook 25 can locate the position of recess portion 35, thereby preventing the first inclined block 31 to insert into the first outlet hole 11 (as shown in FIG. 4 and FIG. 9). Moreover, when a first terminal 51 and a second terminal 52 of a plug 50 are respectively pulled from the first outlet hole 11 and the second outlet hole 12, the elastic element (e.g., a spring 40) can push the sliding element 30 to return to starting position of the sliding element 30, the hook 25 can limit the position of the sliding element 30 (as shown in FIG. 6).

Examples of a fourth variation of the base 20 and the sliding element 30; the through hole 33 can be a T-shaped hole, the first terminal 51 can pass through a crosswise hole 331 of the T-shaped hole, the first post 21 can pass through a lengthwise hole 332 of the T-shaped hole; the lengthwise hole 332 can contain the first post 21, the second post 322 and the elastic element (e.g., a spring 40); the two ends of the elastic element are respectively fixed on the first post 21 and the second post 322 (as shown in FIG. 1 to FIG. 5).

Examples of a fifth variation of the base 20 and the sliding element 30; the sliding element 30 has a first inclined surface 301 and a second inclined surface 302; when a single object 60 is inserted into the first outlet hole 11, the object 60 will push the first inclined block 31, the first inclined surface 301 can press on an inner surface 202 of the base 20 (as shown in FIG. 8); when the object 60 is inserted into the second outlet hole 12, the object 60 will push the second inclined block 32, the second inclined surface 302 can press on an inner surface 202 of the base 20 (as shown in FIG. 9).

Examples of a fixing manner of the base 20; the base 20 has at least one L-shaped fixing portion 26, the L-shaped fixing portion 26 can be embedded in a fixing slot 16 to fix the base 20 on the shell body 10.

Examples of a variation of the shell body 10; the shell body 10 has at least one fifth outlet hole 15, the first outlet hole 11 can be a fire wire terminal socket, the second outlet hole 12 can be a neutral wire terminal socket, the fifth outlet hole 15 can be a ground terminal socket.

Figure 10:
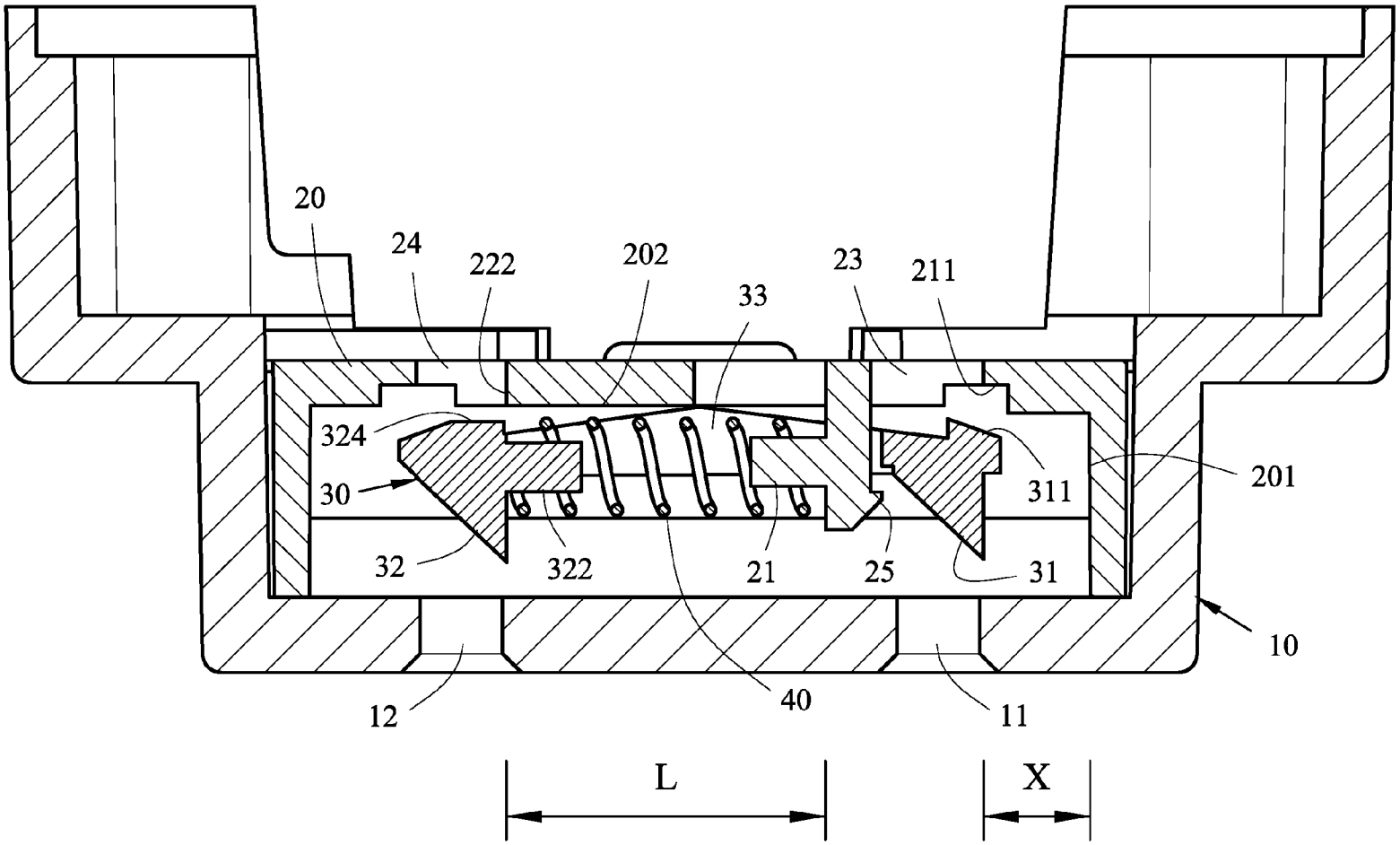
FIG. 10 is a cross-sectional view along the line A-A of FIG. 1 showing a second preferred embodiment of the invention.

Referring to FIG. 10, in a second embodiment of the invention, a distance X between the first inclined block 31 and an inner wall 201 of the base 20 can be further lessened, the distance X between the first inclined block 31 and an inner wall 201 of the base 20 only needs to be larger than the sliding stroke of the sliding element 30; wherein the sliding stroke of the sliding element 30 is just larger than the width of the first outlet hole 11, or the sliding stroke of the sliding element 30 is just larger than the width of the second outlet hole 12.

Figure 11:
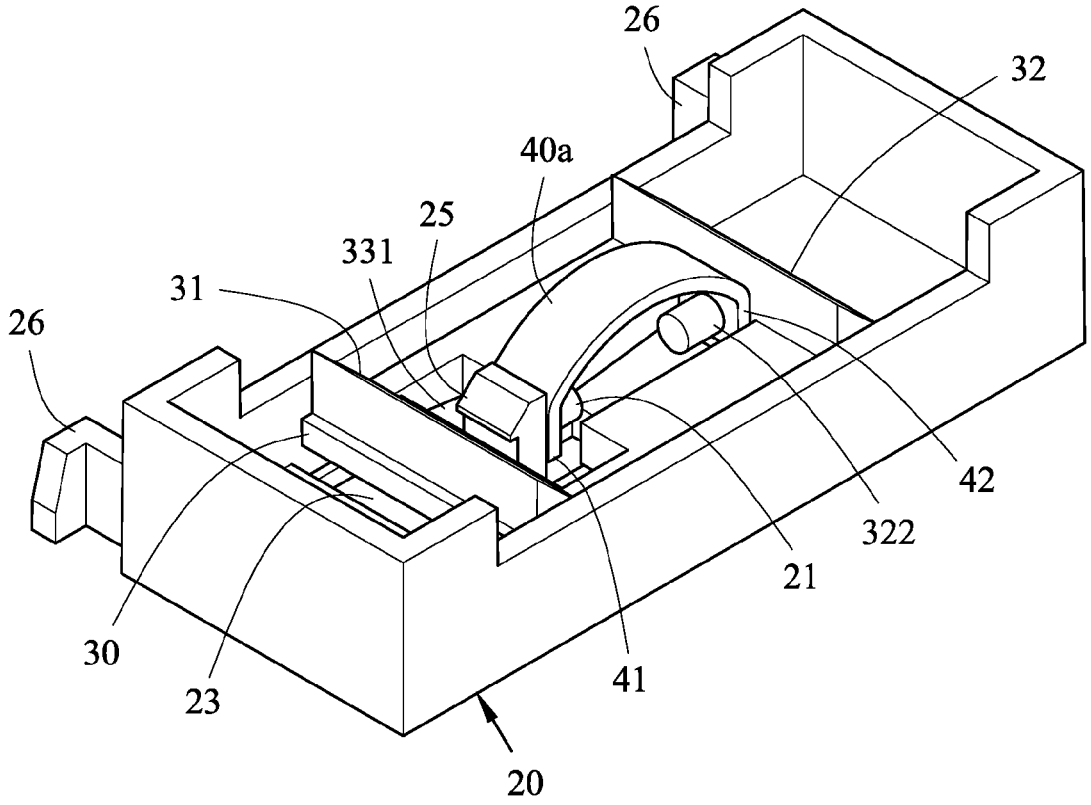
FIG. 11 is a partially perspective view showing a third preferred embodiment of the invention.
Figure 12:
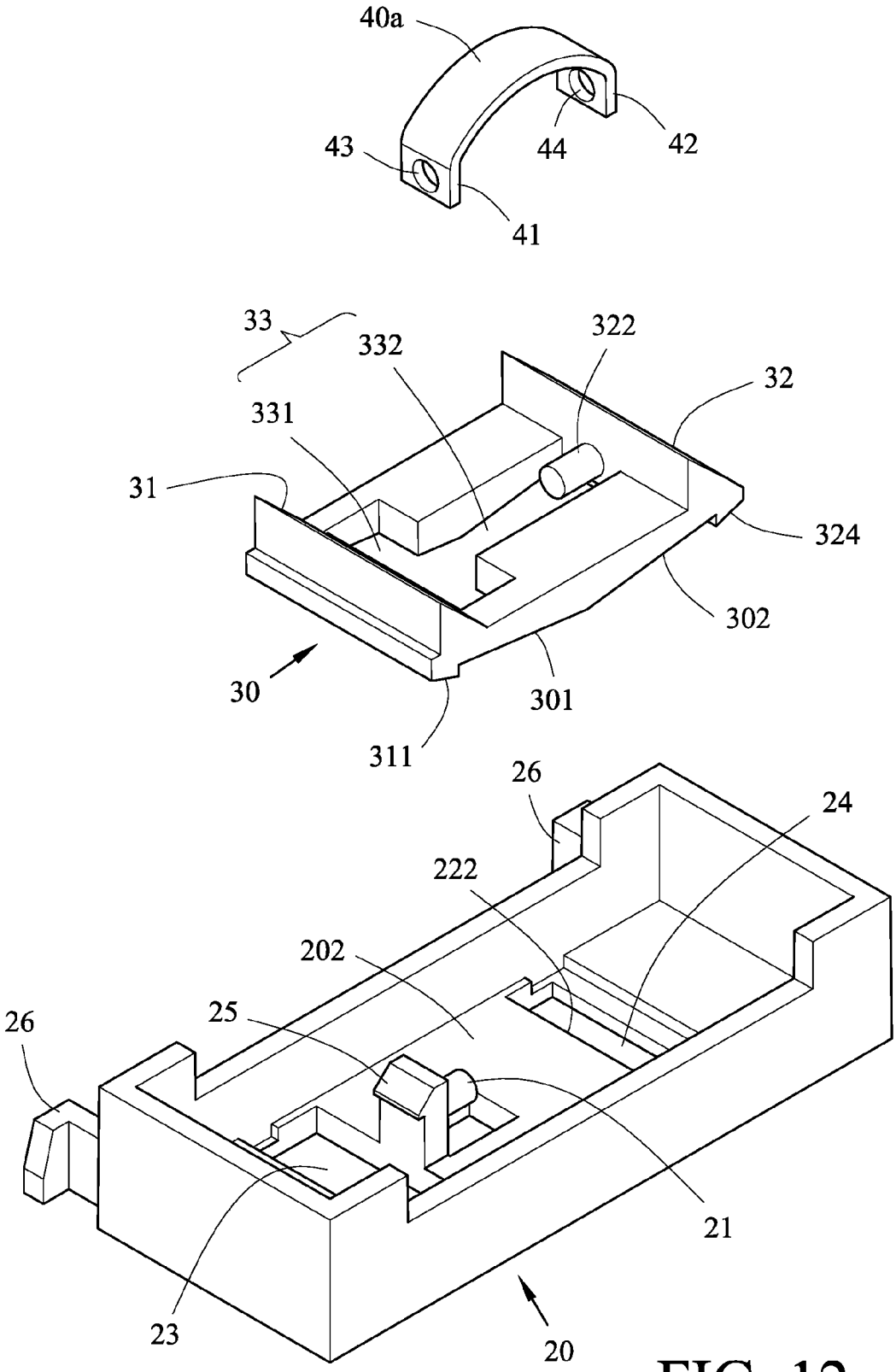
FIG. 12 is a partially exploded view showing the third preferred embodiment of the invention.
Figure 13:
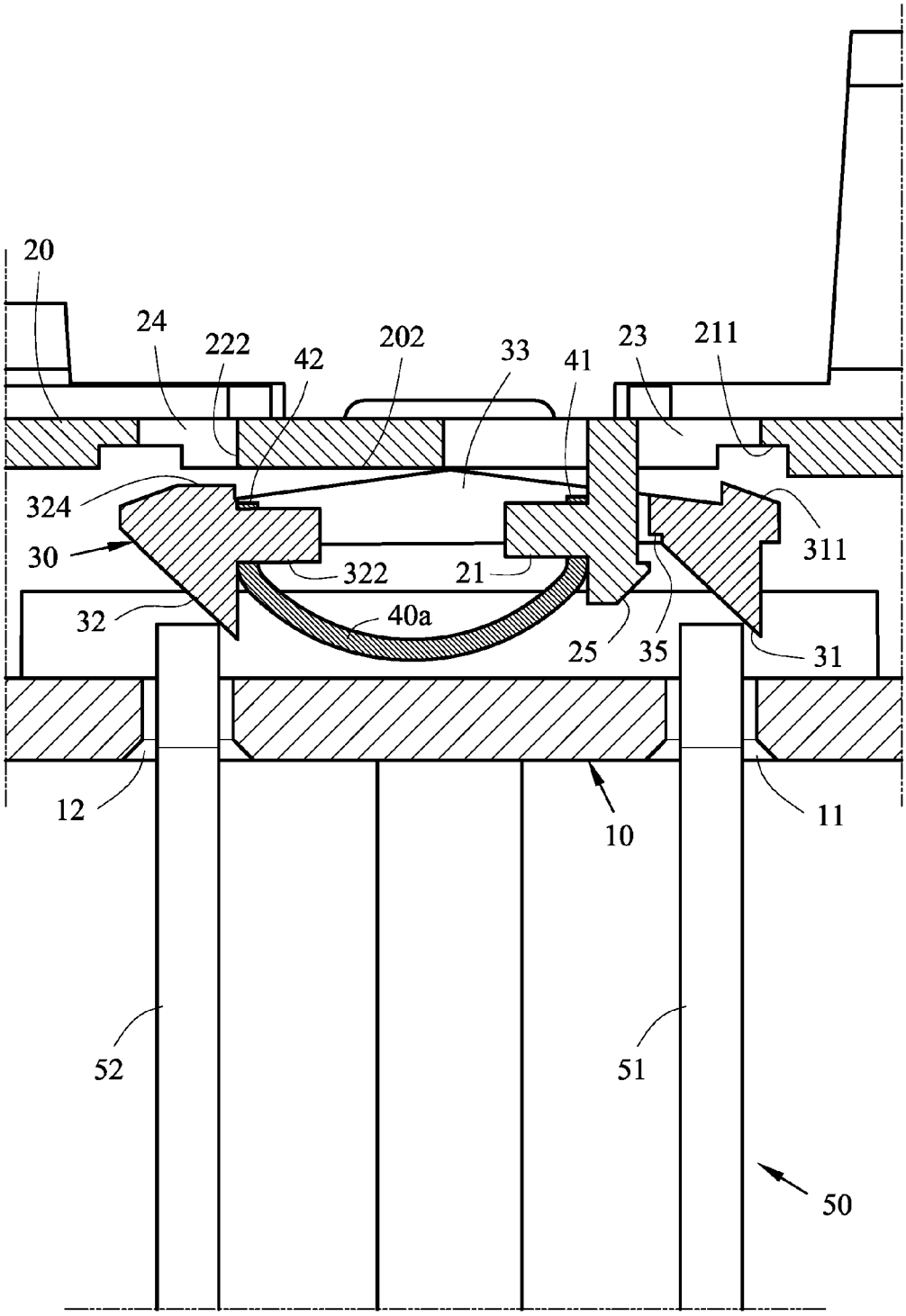
FIG. 13 is an assemble diagram illustrating the assemble state of the third preferred embodiment of the invention.

Referring to FIGS. 11 to 13, in a third embodiment of the invention, the elastic element can be a spring leaf **40*a*, the spring leaf 40*a* has a first fixing terminal 41 and a second fixing terminal 42, the first fixing terminal 41 has a first fixing hole 43, the second fixing terminal 42 has a second fixing hole 44; wherein the through hole 33 can be a T-shaped hole, the first terminal 51 can pass through a crosswise hole 331 of the T-shaped hole, the first post 21 can pass through a lengthwise hole 332 of the T-shaped hole; the lengthwise hole 332 can contain the first post 21, the second post 322 and the spring leaf 40*a*; the first fixing terminal 41 can use the first fixing hole 43 to fix on the first post 21, the second fixing terminal 42 can use the second fixing hole 44 to fix on the second post 322**.

What is claimed is:

1. A power outlet having safety cover, the power outlet comprising:

a shell body (10) having at least one first outlet hole (11) and at least one second outlet hole (12);

at least one base (20) fixed in the shell body (10), the base (20) has a first post (21), a third outlet hole (23) and a fourth outlet hole (24);

at least one sliding element (30) disposed between the shell body (10) and the base (20), one side of the sliding element (30) has a first inclined block (31), the middle of the sliding element (30) has a through hole (33), another side of the sliding element (30) has a second inclined block (32) and a second post (322);

at least one elastic element disposed between the first post (21) and the second post (322);

wherein the through hole (33) can contain the first post (21), the second post (322) and the elastic element; when a first terminal (51) and a second terminal (52) of a plug (50) respectively insert into the first outlet hole (11) and the second outlet hole (12), the first terminal (51) and the second terminal (52) will respectively push the first inclined block (31) and the second inclined block (32), the sliding element (30) can slide to compress the elastic element, the first terminal (51) can pass through the through hole (33) and the third outlet hole (23), the second terminal (52) can pass through the fourth outlet hole (24).

2. The power outlet having safety cover of claim 1, wherein the base (20) has a first location portion (211), the sliding element (30) has a first location block (311); when a single object (60) is inserted into the first outlet hole (11), the object (60) will push the first inclined block (31), the first location portion (211) can stop the first location block (311) to locate the position of the sliding element (30), the first inclined block (31) can block the object (60) to pass through the third outlet hole (23).

3. The power outlet having safety cover of claim 1, wherein the base (20) has a second location portion (222), the sliding element (30) has a second location block (324); when a single object (60) is inserted into the second outlet hole (12), the object (60) will push the second inclined block (32), the second location portion (222) can stop the second location block (324) to locate the position of the sliding element (30), the second inclined block (32) can block the object (60) to pass through the fourth outlet hole (24).

4. The power outlet having safety cover of claim 1, wherein the base (20) has a hook (25), the sliding element (30) has a recess portion (35); when a single object (60) is inserted into the second outlet hole (12), the object (60) will push the second inclined block (32), the hook (25) can locate the position of recess portion (35), thereby preventing the first inclined block (31) to insert into the first outlet hole (11).

5. The power outlet having safety cover of claim 1, wherein the elastic element can be a spring (40), the through hole (33) can be a T-shaped hole, the first terminal (51) can pass through a crosswise hole (331) of the T-shaped hole, the first post (21) can pass through a lengthwise hole (332) of the T-shaped hole; the lengthwise hole (332) can contain the first post (21), the second post (322) and the spring (40); the two ends of the spring (40) are respectively fixed on the first post (21) and the second post (322).

6. The power outlet having safety cover of claim 1, wherein the elastic element can be a spring leaf (40*a*), the spring leaf (40*a*) has a first fixing terminal (41) and a second fixing terminal (42), the first fixing terminal (41) has a first fixing hole (43), the second fixing terminal (42) has a second fixing hole (44); the through hole (33) can be a T-shaped hole, the first terminal (51) can pass through a crosswise hole (331) of the T-shaped hole, the first post (21) can pass through a lengthwise hole (332) of the T-shaped hole; the lengthwise hole (332) can contain the first post (21), the second post (322) and the spring leaf (40*a*); the first fixing terminal (41) can use the first fixing hole (43) to fix on the first post (21), the second fixing terminal (42) can use the second fixing hole (44) to fix on the second post (322).

7. The power outlet having safety cover of claim 1, wherein the sliding element (30) has a first inclined surface (301) and a second inclined surface (302); when a single object (60) is inserted into the first outlet hole (11), the object (60) will push the first inclined block (31), the first inclined surface (301) can press on an inner surface (202) of the base (20); when the object (60) is inserted into the second outlet hole (12), the object (60) will push the second inclined block (32), the second inclined surface (302) can press on an inner surface (202) of the base (20).

8. The power outlet having safety cover of claim 1, wherein the base (20) has at least one L-shaped fixing portion (26), the L-shaped fixing portion (26) can be embedded in a fixing slot (16) to fix the base (20) on the shell body (10).

9. The power outlet having safety cover of claim 1, wherein the shell body (10) has at least one fifth outlet hole (15), the first outlet hole (11) can be a fire wire terminal socket, the second outlet hole (12) can be a neutral wire terminal socket, the fifth outlet hole (15) can be a ground terminal socket.

10. A power outlet having safety cover, the power outlet comprising:

a shell body (10) having at least one first outlet hole (11) and at least one second outlet hole (12);

at least one base (20) fixed in the shell body (10), the base (20) has a first post (21), a third outlet hole (23) and a fourth outlet hole (24);

at least one sliding element (30) disposed between the shell body (10) and the base (20), one side of the sliding element (30) has a first inclined block (31), the middle of the sliding element (30) has a through hole (33), another side of the sliding element (30) has a second inclined block (32) and a second post (322);

at least one elastic element disposed between the first post (21) and the second post (322);

wherein a distance (X) between the first inclined block (31) and an inner wall (201) of the base (20) is smaller than the length (L) of the elastic element; when a first terminal (51) and a second terminal (52) of a plug (50) respectively insert into the first outlet hole (11) and the second outlet hole (12), the first terminal (51) and the second terminal (52) will respectively push the first inclined block (31) and the second inclined block (32), the sliding element (30) can slide to compress the elastic element, the first terminal (51) can pass through the through hole (33) and the third outlet hole (23), the second terminal (52) can pass through the fourth outlet hole (24).

11. The power outlet having safety cover of claim 10, wherein the base (20) has a first location portion (211), the sliding element (30) has a first location block (311); when a single object (60) is inserted into the first outlet hole (11), the object (60) will push the first inclined block (31), the first location portion (211) can stop the first location block (311) to locate the position of the sliding element (30), the first inclined block (31) can block the object (60) to pass through the third outlet hole (23).

12. The power outlet having safety cover of claim 10, wherein the base (20) has a second location portion (222), the sliding element (30) has a second location block (324); when a single object (60) is inserted into the second outlet hole (12), the object (60) will push the second inclined block (32), the second location portion (222) can stop the second location block (324) to locate the position of the sliding element (30), the second inclined block (32) can block the object (60) to pass through the fourth outlet hole (24).

13. The power outlet having safety cover of claim 10, wherein the base (20) has a hook (25), the sliding element (30) has a recess portion (35); when a single object (60) is inserted into the second outlet hole (12), the object (60) will push the second inclined block (32), the hook (25) can locate the position of recess portion (35), thereby preventing the first inclined block (31) to insert into the first outlet hole (11).

14. The power outlet having safety cover of claim 10, wherein the elastic element can be a spring (40), the through hole (33) can be a T-shaped hole, the first terminal (51) can pass through a crosswise hole (331) of the T-shaped hole, the first post (21) can pass through a lengthwise hole (332) of the T-shaped hole; the lengthwise hole (332) can contain the first post (21), the second post (322) and the spring (40); the two ends of the spring (40) are respectively fixed on the first post (21) and the second post (322).

15. The power outlet having safety cover of claim 10, wherein the elastic element can be a spring leaf (40*a*), the spring leaf (40*a*) has a first fixing terminal (41) and a second fixing terminal (42), the first fixing terminal (41) has a first fixing hole (43), the second fixing terminal (42) has a second fixing hole (44); the through hole (33) can be a T-shaped hole, the first terminal (51) can pass through a crosswise hole (331) of the T-shaped hole, the first post (21) can pass through a lengthwise hole (332) of the T-shaped hole; the lengthwise hole (332) can contain the first post (21), the second post (322) and the spring leaf (40*a*); the first fixing terminal (41) can use the first fixing hole (43) to fix on the first post (21), the second fixing terminal (42) can use the second fixing hole (44) to fix on the second post (322).

16. The power outlet having safety cover of claim 10, wherein the sliding element (30) has a first inclined surface (301) and a second inclined surface (302); when a single object (60) is inserted into the first outlet hole (11), the object (60) will push the first inclined block (31), the first inclined surface (301) can press on an inner surface (202) of the base (20); when the object (60) is inserted into the second outlet hole (12), the object (60) will push the second inclined block (32), the second inclined surface (302) can press on an inner surface (202) of the base (20).

* * * * *